US011617406B1

(12) United States Patent
Fiala

(10) Patent No.: US 11,617,406 B1
(45) Date of Patent: Apr. 4, 2023

(54) HANDHELD DEVICE FOR APPLYING EYELASH EXTENSIONS

(71) Applicant: Christopher Fiala, Lincoln, NE (US)

(72) Inventor: Christopher Fiala, Lincoln, NE (US)

( * ) Notice: Subject to any disclaimer, the term of this patent is extended or adjusted under 35 U.S.C. 154(b) by 518 days.

(21) Appl. No.: 16/935,901

(22) Filed: Jul. 22, 2020

Related U.S. Application Data

(60) Provisional application No. 62/887,211, filed on Aug. 15, 2019.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/00; A41G 5/0053; A45D 26/0066; A45D 26/0071; A45D 26/0076; A61B 17/30; A61B 2017/305; A61F 9/0061; A61F 2/1662; A61F 2/1664; D05B 97/08
See application file for complete search history.

(56) References Cited

U.S. PATENT DOCUMENTS 1,991,816 A * 2/1935 Tomlinson ..... A45D 26/0076 606/133
2,123,870 A * 7/1938 Wehmer ..... A45D 26/0076 310/34
2,667,176 A * 1/1954 Wassmer ..... A41G 5/02 140/93 R
3,645,281 A * 2/1972 Seidler ..... B65D 75/28 206/460
4,240,435 A * 12/1980 Yazawa ..... A45D 26/0071 294/99.2
4,936,452 A * 6/1990 Pauley ..... A47K 10/3827 225/84
5,133,722 A * 7/1992 Avrahami ..... A45D 26/0052 606/1
6,280,449 B1 * 8/2001 Blake ..... A61F 2/1664 606/107
(Continued)

FOREIGN PATENT DOCUMENTS

FR 2990604 A1 * 11/2013 ..... A41G 5/02
FR 2990605 A1 * 11/2013 ..... A41G 5/0086
(Continued)

*Primary Examiner* — Jacqueline T Johanas
*Assistant Examiner* — Sarah Woodhouse
(74) *Attorney, Agent, or Firm* — Nasr Patent Law LLC; Faisal K. Abou-Nasr

(57) ABSTRACT

A handheld device for applying eyelash extensions is disclosed. The handheld device includes a device enclosure with an opening at a distal end of the device enclosure. The handheld device further includes tweezers at least partially disposed within the device enclosure. The tweezers are configured to grasp one or more lashes from a lash cartridge at least partially disposed within or coupled to the device enclosure. The tweezers are coupled to a tweezer actuator at least partially disposed within the device enclosure. The tweezer actuator is configured to selectively position the tweezers between a rest position and an extended position, wherein the tweezers are configured to extend the one or more lashes grasped by the tweezers through the opening at the distal end of the device enclosure when the tweezers are in the extended position.

20 Claims, 10 Drawing Sheets

(56) References Cited

U.S. PATENT DOCUMENTS 6,605,093 B1 * 8/2003 Blake ..... A61F 2/1664 606/107
7,875,029 B1 * 1/2011 Hausen ..... A61B 18/1447 606/51
2003/0028218 A1 * 2/2003 Bauer ..... A61B 17/08 606/213
2009/0072006 A1 * 3/2009 Clauson ..... A61B 17/0684 227/176.1
2009/0134198 A1 * 5/2009 Knodel ..... A61B 17/0684 227/176.1
2012/0000957 A1 * 1/2012 Martinez ..... B65H 37/005 225/57
2014/0261514 A1 * 9/2014 Martins ..... A41G 5/02 132/201
2014/0263392 A1 * 9/2014 Martins ..... B65D 83/0864 221/71
2014/0276978 A1 * 9/2014 Shields ..... A61B 17/062 606/144
2015/0136162 A1 * 5/2015 Brouillet ..... A41G 5/02 132/286
2015/0181968 A1 * 7/2015 Uresti ..... A41G 5/0086 132/286
2016/0000423 A1 * 1/2016 Shields ..... A61B 17/062 606/147
2016/0280501 A1 * 9/2016 Crapet ..... A41G 5/02
2017/0006947 A1 * 1/2017 Uresti ..... A41G 5/02
2017/0119123 A1 * 5/2017 Sanders ..... A41G 5/0086
2017/0135713 A1 * 5/2017 Suh ..... A61B 17/3468
2017/0253418 A1 * 9/2017 Roh ..... B65D 83/0083
2017/0253419 A1 * 9/2017 Roh ..... B65D 83/087
2017/0258163 A1 * 9/2017 Uresti ..... A41G 5/02
2017/0311701 A1 * 11/2017 Brouillet ..... A45D 44/00
2019/0125357 A1 * 5/2019 Shelton, IV ..... A61B 90/98
2020/0037688 A1 * 2/2020 Horblitt ..... B05C 5/0208
2020/0288802 A1 * 9/2020 Lee ..... A41G 5/02

FOREIGN PATENT DOCUMENTS

FR 3067232 A1 * 12/2018 ..... A41G 5/02
FR 3067572 A1 * 12/2018 ..... A41G 5/02
GB 2535714 A * 8/2016 ..... A41G 5/0066
JP H06166904 A * 6/1994
KR 1020150008290 A * 1/2015
WO 2013171405 A1 11/2013
WO WO-2018093967 A1 * 5/2018 ..... A41D 13/11

* cited by examiner

HANDHELD DEVICE FOR APPLYING EYELASH EXTENSIONS

CROSS-REFERENCE TO RELATED APPLICATIONS

The present application claims the benefit under 35 U.S.C. § 119(e) of U.S. Provisional Application Ser. No. 62/887,211, filed Aug. 15, 2019, and titled "INDIVIDUAL FALSE EYELASH GUIDANCE AND POSITIONING SYSTEM," which is incorporated herein by reference in its entirety.

TECHNICAL FIELD

The present invention generally relates to eyelash extensions, and more particularly, to a handheld device for applying eyelash extensions.

BACKGROUND

Eyelash extensions may be used to enhance the length, thickness, and volume of natural eyelashes. For example, eyelash extensions may be glued to the base of a natural eyelash, where the natural eyelash meets the eyelid. Professional estheticians generally apply an individual lash (or a small cluster of lashes) to each individual natural eyelash. This one-to-one method requires the professional to use an adhesive and two pairs of forceps: a first pair of forceps is used to remove a lash from a lash strip and apply the lash to the eyelid; and a second pair of forceps is used to separate and isolate the individual, natural lash from the plurality of natural lashes. This process requires the professional to pivot back and forth between the steps of: (1) grabbing and removing individual lashes from the lash strip; and (2) applying the lashes to the eyelid. Applying individual eyelash extensions with this process is tedious and can take as long as 2 to 3 hours for a full set. Consequently, there is a need for technologies that can speed up and/or simplify the process of applying eyelash extensions.

SUMMARY

A handheld device for applying eyelash extensions is disclosed. In embodiments, the handheld device includes a device enclosure with an opening at a distal end of the device enclosure. The handheld device further includes tweezers at least partially disposed within the device enclosure. The tweezers may be configured to grasp one or more lashes from a lash cartridge at least partially disposed within or coupled to the device enclosure. The tweezers are coupled to a tweezer actuator that is also at least partially disposed within the device enclosure. The tweezer actuator may be configured to selectively position the tweezers between a rest position and an extended position, wherein the tweezers are configured to extend the one or more lashes grasped by the tweezers through the opening at the distal end of the device enclosure when the tweezers are in the extended position.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

DETAILED DESCRIPTION

Reference will now be made in detail to the subject matter disclosed, which is illustrated in the accompanying drawings.

FIGS. 1A through 10 illustrate a handheld device 100 for applying eyelash extensions, in accordance with one or more embodiments of the present disclosure. It is contemplated that the use of such a device or system may allow for a reduced application time per lash, as well as a simplified process for applying eyelash extensions. In the present disclosure, the terms "lash" or "lashes" when used in the context of eyelash extensions may include, but are not limited to, synthetic lashes for eyelash extensions or eyelash extension lashes made from human hair, animal hair, silk, or any other substance.

Figure 1B:
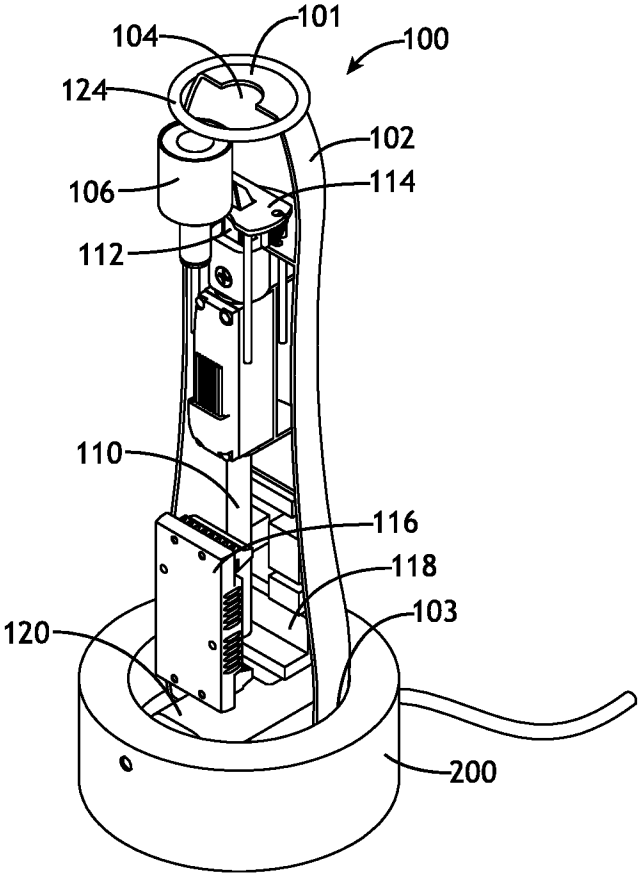
FIG. 1B is a perspective front view of the handheld device for applying eyelash extensions, wherein a portion of a device enclosure for the handheld device is removed, in accordance with one or more embodiments of the present disclosure.
Figure 1A:
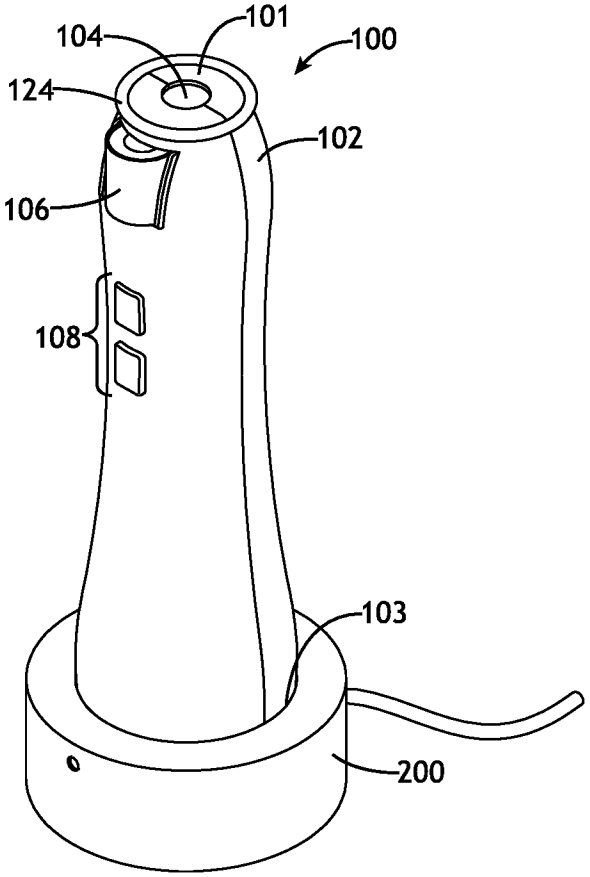
FIG. 1A is a perspective front view of a handheld device for applying eyelash extensions, in accordance with one or more embodiments of the present disclosure.

As shown in FIGS. 1A and 1B, the handheld device 100 may include a device enclosure 102 with an opening 104 at a distal end 101 of the device enclosure 102. In embodiments, various components may be fully or partially housed within the device enclosure 102. The device enclosure 102 may be an integrated structure (e.g., formed from a single mold or 3D print); alternatively, the device enclosure 102 may be formed from several pieces assembled together. The distal end 101 of the device enclosure 102 may include an opening 104 defined by one or more walls of the device enclosure 102. This opening 104 may allow deployment of lashes 107 from the handheld device 100 via tweezers 112 when the tweezers 112 are in an extended position. The device enclosure 102 may additionally include a dedicated opening/cavity configured to receive a lash cartridge 106. In some embodiments, the device enclosure 102 includes one or more structures configured to mate with complementary structures on the lash cartridge 106 so that the lash cartridge 106 may be snapped into the device enclosure 102. This is one example of how the lash cartridge 106 may be removably coupled to the device enclosure 102. However, this is not intended to be limiting. For example, in other embodiments, the lash cartridge 106 may be reversibly or permanently attached within the handheld device 100 to a gear or a rotary actuator (e.g., cartridge actuator 122). Consequently, the handheld device 100 may require removal of a portion of the device enclosure 102 to refill and/or replace the lash cartridge 106.

The handheld device 100 may include a motion controller 116 (e.g., a microcontroller, microprocessor, ASIC, FPGA, or the like) configured to selectively control one or more components (e.g., tweezer actuator 110, cartridge actuator 122, guide/status light 124, etc.). Additionally, the device enclosure 102 may include a user control interface 108 (e.g., one or more buttons, switches, or toggles, a touchpad, or any other human machine interface) configured to send a user input signal to the motion controller 116, adapter board 118, and/or any other system/device components. For example, as shown in FIGS. 2A through 4B, in response to a user input (e.g., press of a button): the lash cartridge 106 may deploy a lash 107 to be engaged by the tweezers 112; a tweezer actuator 110 may cause the tweezers 112 to engage and grasp the lash 107; and the tweezer actuator 110 may deploy the tweezers 112 and lash 107 through the opening 104 at the distal end 101 of the device enclosure 102. The orders listed above is not intended to be limiting. For example, the lash 107 may be engaged by the tweezers 112 at any point between the rest position (shown in FIGS. 2A and 2B) and the extend position (shown in FIGS. 4A and 4B). By way of another example, the lash 107 may be deployed at any point, such as, but not limited to, immediately after the user input, as the tweezers 112 actuate from the rest position, or after the tweezers have returned to the rest position.

Figure 9A:
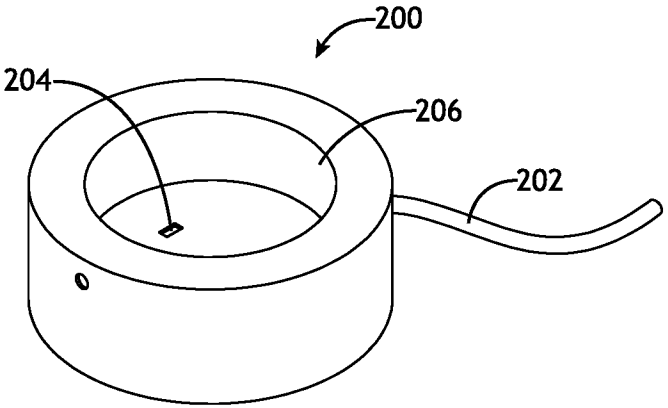
FIG. 9A is a perspective front view of a charging base of the handheld device for applying eyelash extensions, in accordance with one or more embodiments of the present disclosure.
Figure 9B:
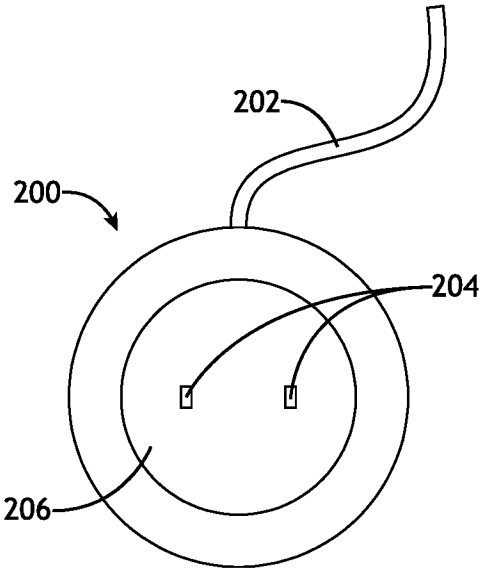
FIG. 9B is a top view of the charging base of the handheld device for applying eyelash extensions, in accordance with one or more embodiments of the present disclosure.
Figure 9C:
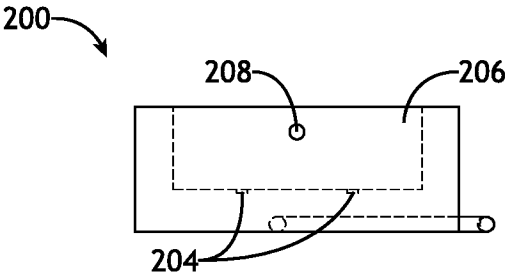
FIG. 9C is a front view of the charging base of the handheld device for applying eyelash extensions, in accordance with one or more embodiments of the present disclosure.

In embodiments, the motion controller 116 and other electronic components (e.g., tweezer actuator 110, cartridge actuator 122, guide/status light 124, etc.) are powered by a power source, such as, but not limited to, a battery or a line voltage. In some embodiments, the power source may include one or more rechargeable batteries 120. The one or more rechargeable batteries 120 may be rechargeable by a charging base 200. In embodiments, the charging base 200 may be configured with dimensions suitable for receiving the handheld device 100 and/or the one or more rechargeable batteries 120. In embodiments, the handheld device 100 includes an adapter board 118 configured to charge the one or more rechargeable batteries 120 from an external power source (e.g., a 120-240V wall outlet, or the like). In some embodiments, the adapter board 118 is configured to connect (e.g., via one or more connectors 105) to a charging base 200 that is configured to furnish power from the external power source (e.g., via power cable 202) to the adapter board 118. The charging base 200 may be configured to receive a proximal end 103 of the handheld device 100 and further configured to hold the handheld device 100 in an upright configuration. For example, as shown in FIGS. 9A through 9C, the charging base 200 may include a cavity 206 configured to receive the proximal end 103 of the handheld device 100 and one or more connectors 204 within the cavity 206, wherein the one or more connectors 204 are configured to mate with the one or more connectors 105 at the proximal end 103 of the handheld device 100. In embodiments, the charging base 200 further includes a status indicator 208 (e.g., a light emitting diode (LED)) may be configured to display one or more states of the battery based on the battery charge (e.g., fully charged, low battery, etc.). It is to be noted that the use of rechargeable batteries 120 is not intended to be limiting. For example, the handheld device 100 may be powered by replaceable batteries known in the art (e.g., AA, AAA, D, 9V, etc.). By way of another example, the handheld device 100 may be powered by a line voltage from a wall outlet (e.g., 120 volts AC configured with an AC to DC adapter, etc.).

Figure 2A:
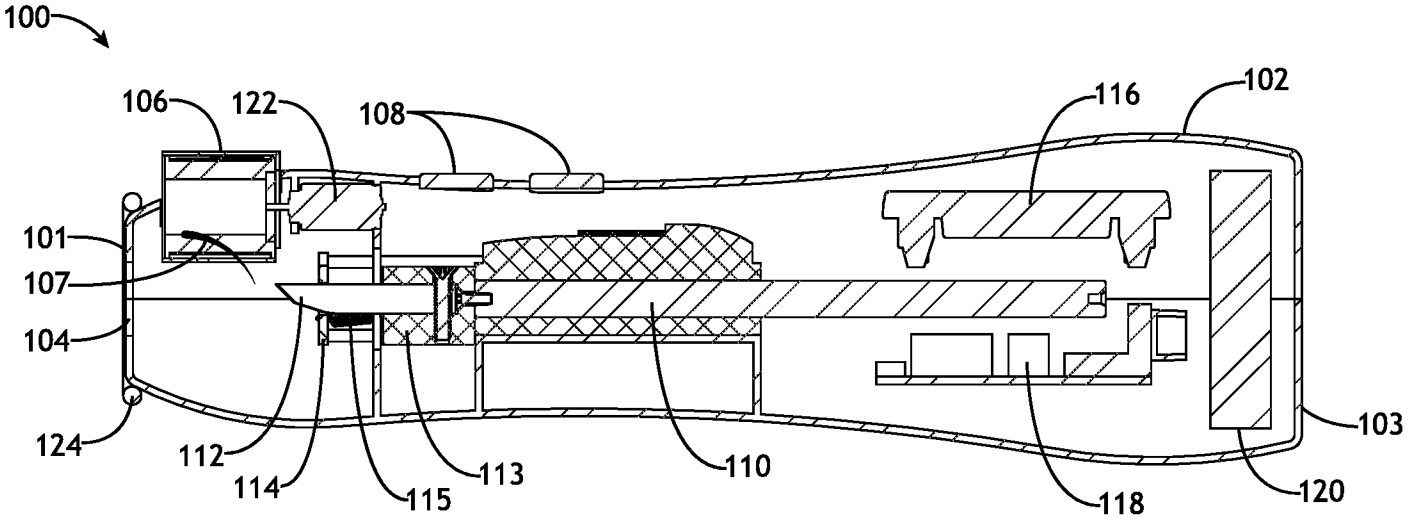
FIG. 2A is a cross-sectional side view of the handheld device for applying eyelash extensions, wherein the handheld device is in a rest state with its tweezers stowed within the device enclosure, in accordance with one or more embodiments of the present disclosure.
Figure 2B:
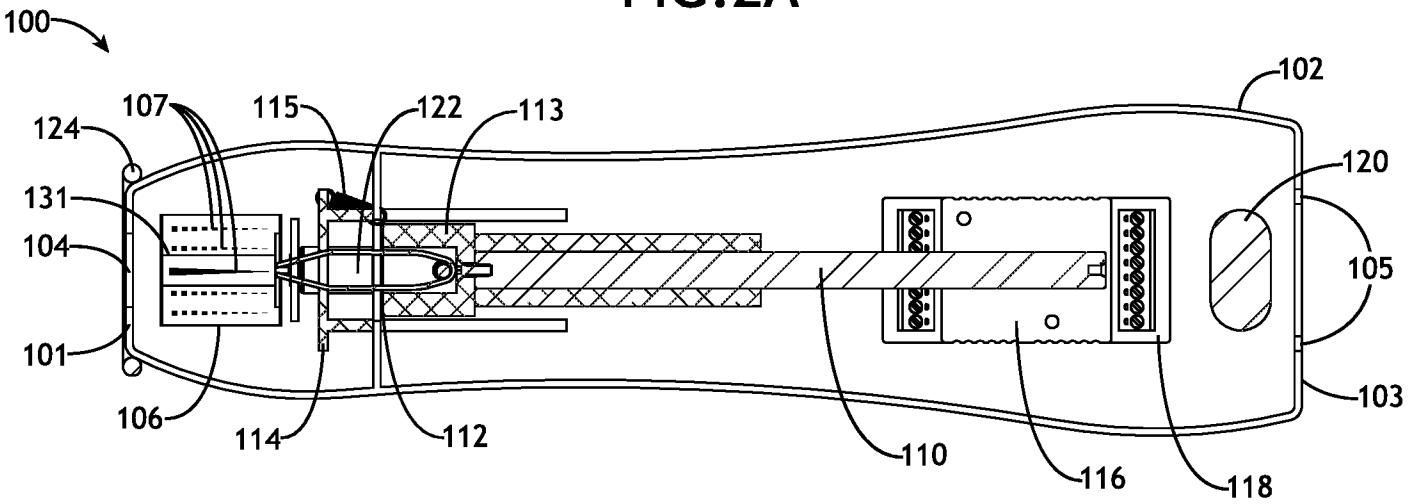
FIG. 2B is a cross-sectional top view of the handheld device for applying eyelash extensions, wherein the handheld device is in a rest state with its tweezers stowed within the device enclosure, in accordance with one or more embodiments of the present disclosure.
Figure 3A:
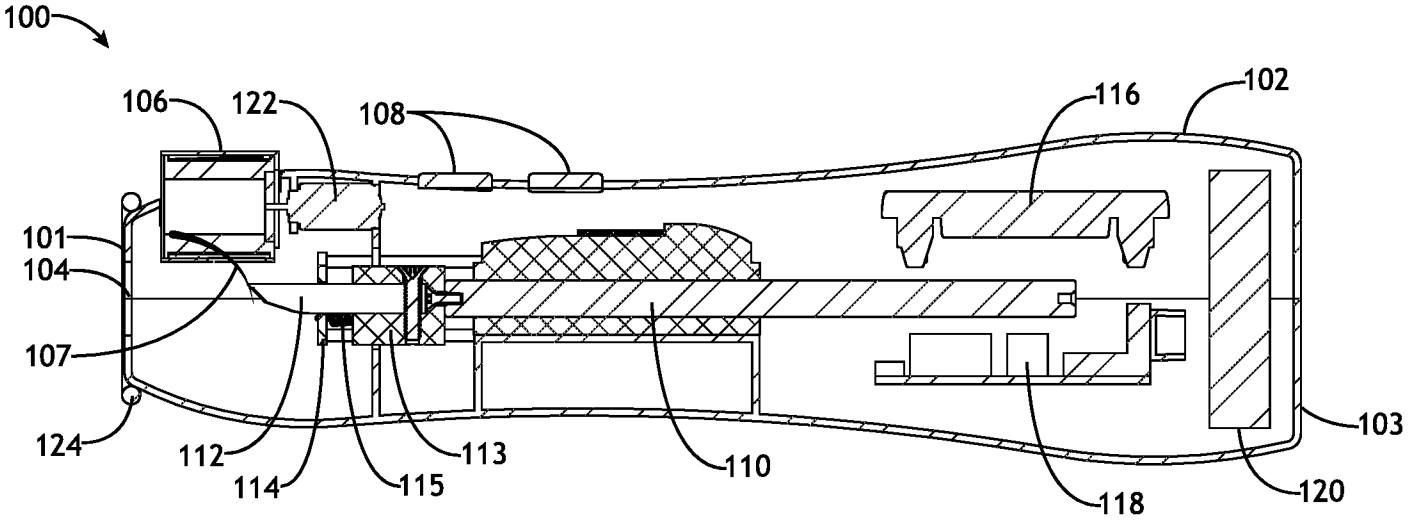
FIG. 3A is a cross-sectional side view of the handheld device for applying eyelash extensions, wherein the handheld device is in a transitional state with its tweezers grasping one or more lashes from a lash cartridge, in accordance with one or more embodiments of the present disclosure.
Figure 3B:
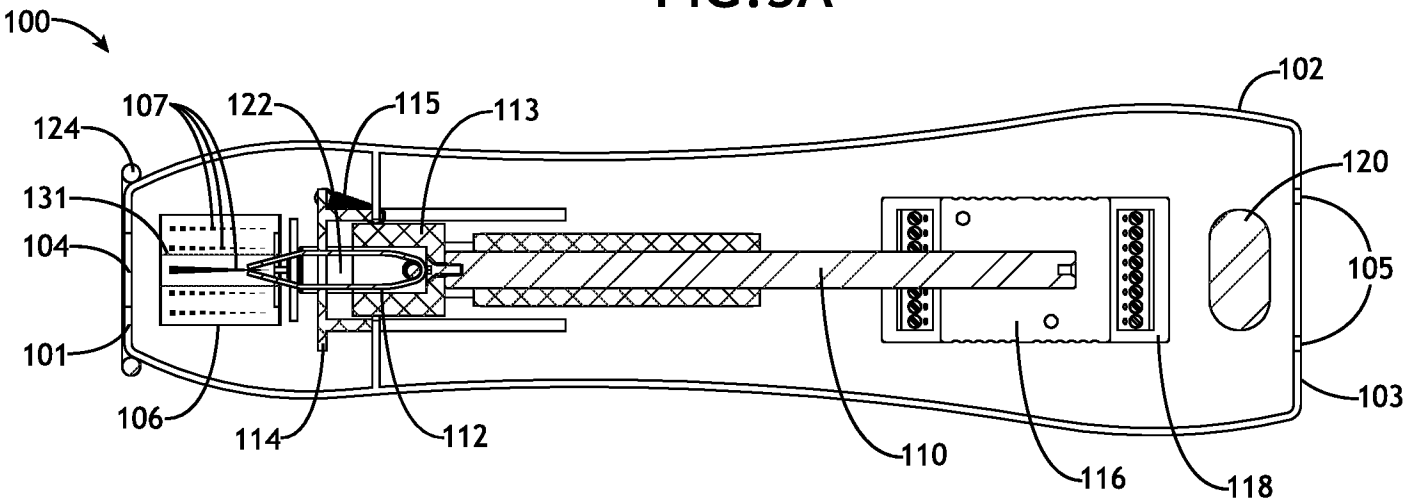
FIG. 3B is a cross-sectional top view of the handheld device for applying eyelash extensions, wherein the handheld device is in a transitional state with its tweezers grasping one or more lashes from a lash cartridge, in accordance with one or more embodiments of the present disclosure.
Figure 4A:
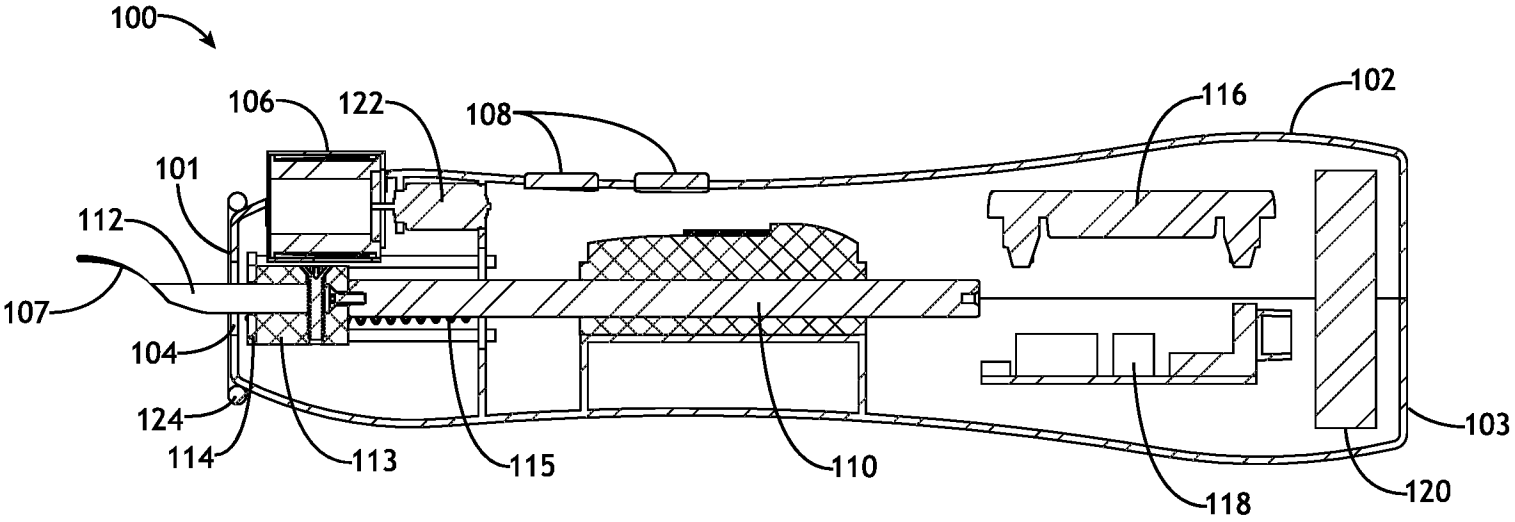
FIG. 4A is a cross-sectional side view of the handheld device for applying eyelash extensions, wherein the handheld device is in a deployed state with its tweezers extended to apply the one or more lashes, in accordance with one or more embodiments of the present disclosure.
Figure 4B:
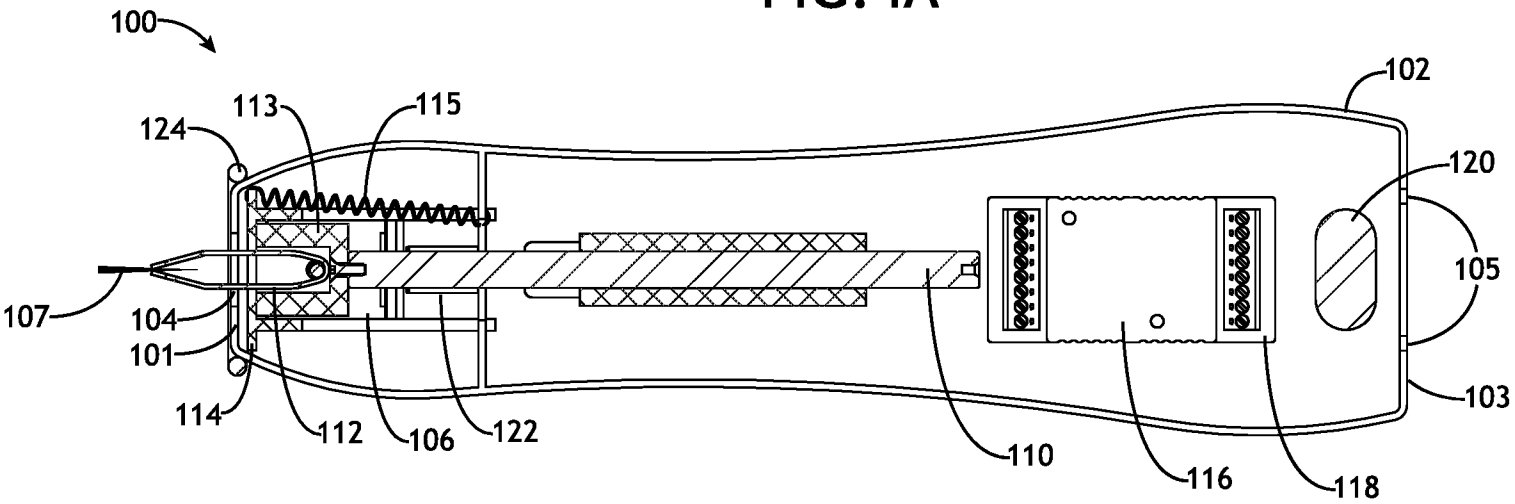
FIG. 4B is a cross-sectional top view of the handheld device for applying eyelash extensions, wherein the handheld device is in a deployed state with its tweezers extended to apply the one or more lashes, in accordance with one or more embodiments of the present disclosure.
Figure 5B:
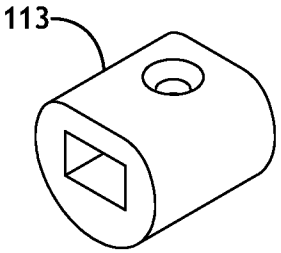
FIG. 5B is a perspective front view of the tweezer mount of the handheld device for applying eyelash extensions, in accordance with one or more embodiments of the present disclosure.
Figure 5D:
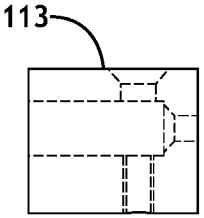
FIG. 5D is a side view of the tweezer mount of the handheld device for applying eyelash extensions, in accordance with one or more embodiments of the present disclosure.
Figure 5A:
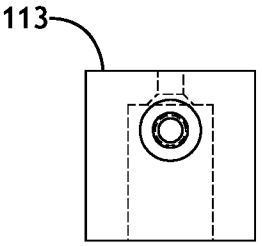
FIG. 5A is a top view of a tweezer mount of the handheld device for applying eyelash extensions, in accordance with one or more embodiments of the present disclosure.
Figure 5C:
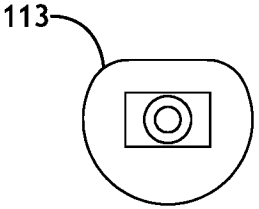
FIG. 5C is a front view of the tweezer mount of the handheld device for applying eyelash extensions, in accordance with one or more embodiments of the present disclosure.
Figure 6B:
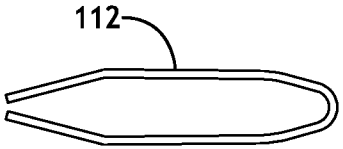
FIG. 6B is a top view of the tweezers of the handheld device for applying eyelash extensions, in accordance with one or more embodiments of the present disclosure.
Figure 6D:
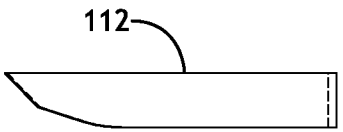
FIG. 6D is a front view of the tweezers of the handheld device for applying eyelash extensions, in accordance with one or more embodiments of the present disclosure.
Figure 6A:
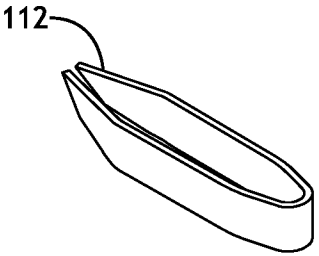
FIG. 6A is a perspective rear view of the tweezers of the handheld device for applying eyelash extensions, in accordance with one or more embodiments of the present disclosure.
Figure 6C:
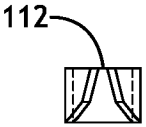
FIG. 6C is a side view of the tweezers of the handheld device for applying eyelash extensions, in accordance with one or more embodiments of the present disclosure.
Figure 7B:
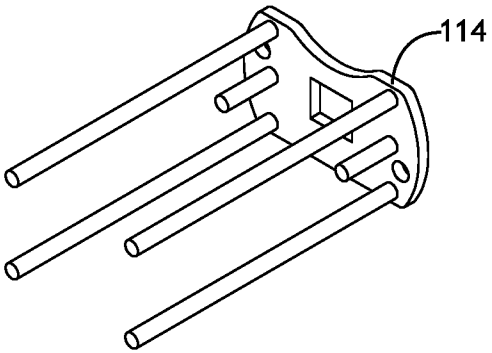
FIG. 7B is a perspective rear view of the restrictor plate for the tweezers of the handheld device for applying eyelash extensions, in accordance with one or more embodiments of the present disclosure.
Figure 7D:
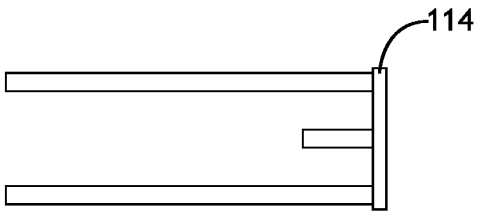
FIG. 7D is a side view of the restrictor plate for the tweezers of the handheld device for applying eyelash extensions, in accordance with one or more embodiments of the present disclosure.
Figure 7A:
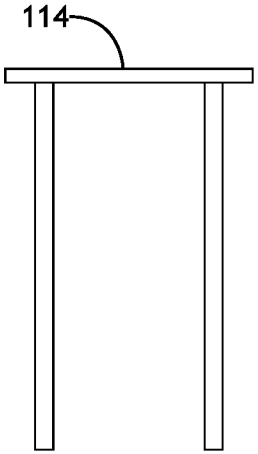
FIG. 7A is a top view of a restrictor plate for the tweezers of the handheld device for applying eyelash extensions, in accordance with one or more embodiments of the present disclosure.
Figure 7C:
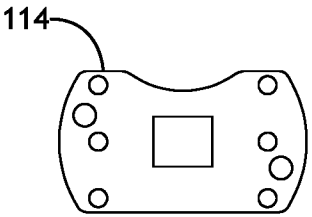
FIG. 7C is a front view of the restrictor plate for the tweezers of the handheld device for applying eyelash extensions, in accordance with one or more embodiments of the present disclosure.
Figure 8B:
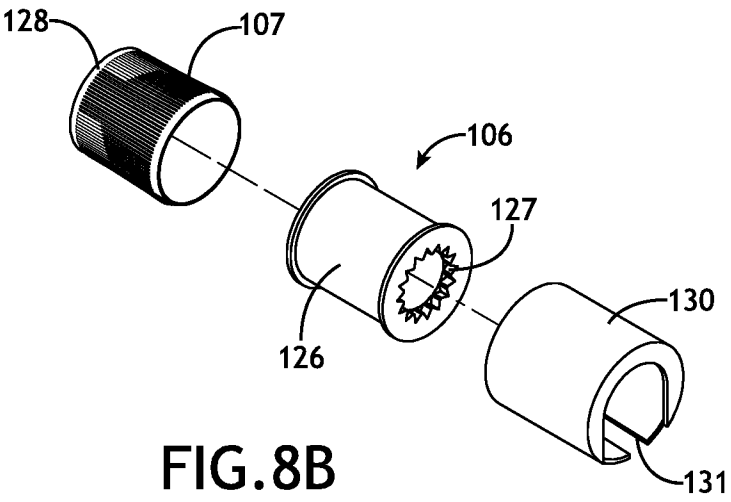
FIG. 8B is an exploded perspective front view of the lash cartridge of the handheld device for applying eyelash extensions, in accordance with one or more embodiments of the present disclosure.
Figure 8A:
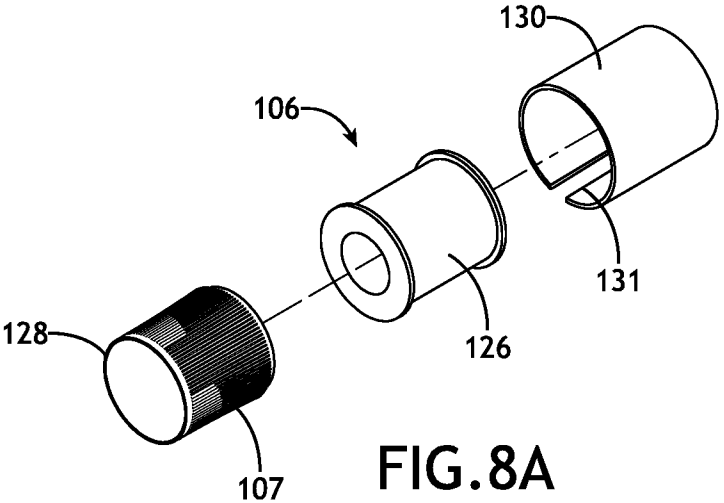
FIG. 8A is an exploded perspective rear view of a lash cartridge of the handheld device for applying eyelash extensions, in accordance with one or more embodiments of the present disclosure.
Figure 8G:
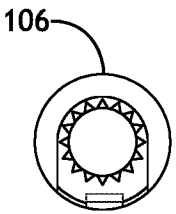
FIG. 8G is a front view of the lash cartridge of the handheld device for applying eyelash extensions, in accordance with one or more embodiments of the present disclosure.
Figure 8F:
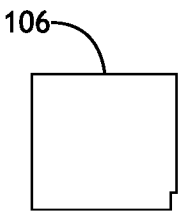
FIG. 8F is a side view of the lash cartridge of the handheld device for applying eyelash extensions, in accordance with one or more embodiments of the present disclosure.
Figure 8E:
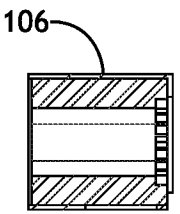
FIG. 8E is a cross-sectional side view of the lash cartridge of the handheld device for applying eyelash extensions, in accordance with one or more embodiments of the present disclosure.
Figure 8D:
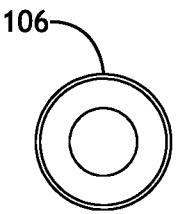
FIG. 8D is a rear view of the lash cartridge of the handheld device for applying eyelash extensions, in accordance with one or more embodiments of the present disclosure.
Figure 8C:
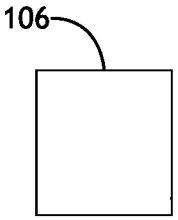
FIG. 8C is a top view of the lash cartridge of the handheld device for applying eyelash extensions, in accordance with one or more embodiments of the present disclosure.

FIGS. 2A through 4B are cross-sectional views of the handheld device 100 illustrating the configuration of various components within the device enclosure 102 and various positions/states of the handheld device 100. For example, FIGS. 2A and 2B illustrate the handheld device 100 in a rest state, wherein the tweezers 112 are in a rest/stowed position; FIGS. 3A and 3B illustrate the handheld device 100 in a transitional state, wherein the tweezers 112 are in a partially extended position to grasp a lash 107 from the lash cartridge 106; and FIGS. 4A and 4B illustrate the handheld device 100 in a deployed state, wherein the tweezers 112 are in an extended (e.g., fully or mostly extended) position to deploy the lash 107 through the opening 104 at the distal end 101 of the device enclosure 102. In embodiments, the tweezers 112 are at least partially disposed within the device enclosure 102. The tweezers 112 may be configured to grasp one or more lashes 107 from the lash cartridge 106, which may be at least partially disposed within and/or coupled to the device enclosure 102. The tweezers 112 are coupled to a tweezer actuator 110 that is also at least partially disposed within the device enclosure 102. The tweezer actuator 110 may be configured to selectively position the tweezers between a rest position and an extended (e.g., fully or mostly extended) position, wherein the tweezers 112 are configured to extend the one or more lashes 107 grasped by the tweezers 112 through the opening 104 at the distal end 101 of the device enclosure 102 when the tweezers 112 are in the extended position.

As shown in FIGS. 2A and 2B, when the tweezers 112 are in the rest position, the tweezers 112 may be stowed within the device enclosure 102. As the tweezers 112 transition from the rest position to the extended position, the tweezers 112 may engage with the one or more lashes 107. The tweezers 112 may be advanced from the rest position to the extended position by the tweezer actuator 110. The tweezer actuator 110 may include, but is not limited to, a solenoid (e.g., a push/pull solenoid), an electromechanical actuator, piezoelectric actuator, a screw-type actuator (e.g., leadscrew, screw jack, ball screw, roller screw, etc.), a linear motor, or other appropriate linear actuator. For example, in some embodiments, the tweezer actuator 110 may be an electric induction motor that produces straight-line motion by means of a linear stator and rotor placed in parallel, in accordance with actuators known in the art. The tweezer actuator 110 may be configured to drive the tweezers 112 by advancing a tweezer mount 113 toward the distal end 101 of the handheld device 100. Various views of the tweezer mount 113 are illustrated in FIGS. 5A through 5D, in accordance with one or more embodiments of the present disclosure.

In embodiments, the handheld device 100 may include a restrictor 114 configured to surround at least a portion of the tweezers 112 and force the tweezers 112 together when the tweezers 112 are extended to grasp the one or more lashes 107 from the lash cartridge 106. For example, as the tweezers 112 transition from the rest position to the extended position, the tweezers 112 may passes through an opening in the restrictor 114 (e.g., a restrictor plate or any other structure that defines an opening configured to receive the tweezers 112). The opening in the restrictor 114 may clamp and/or pinch the tweezers 112 due to the geometry of the tweezers 112 and the opening. The clamping and/or pinching of the tweezers 112 may cause the tweezers 112 to grasp and/or engage the lash 107 being deployed from the lash cartridge 106.

The tweezer actuator 110 may be selectively controlled by any suitable means, including but not limited to, a user control interface 108 and motion controller 116. For example, the motion controller 116 may be configured to control the linear motion of the tweezer actuator 110. In some embodiments, the motion controller 116 also controls a cartridge actuator 122 (e.g., a rotary actuator) that rotates the lash cartridge 106 in response to the user input (e.g., press of a button or any other suitable interaction with the user control interface 108). Furthermore, the adapter board 118 may include circuitry to provide expanded capability to a controller (e.g., the motion controller 116). However, the use of a motion controller 116 and/or an adapter board 118 is not intended to be limiting. For example, the tweezer actuator 110 may be selectively controlled by a lead wire connection to a power source (e.g., a battery 120 or a line voltage). By way of another example, the tweezer actuator 110 may be selectively controlled by a mechanical input, such as, but not limited to, a lever.

In some embodiments, the tweezers 112 may remain in the extended position after a first input. Thus, a second input may be required to move the tweezers 112 from the extended position back to the rest position. For example, a user may press a second button (or same button) or toggle a switch. However, the second input is not intended to be limiting. For example, the handheld device 100 may require a continuous input from the one or more buttons, switches, or other mechanisms to retain the tweezers 112 in the extended configuration.

FIGS. 3A and 3B illustrate the tweezers 112 grasping one or more lashes 107 from the lash cartridge 106, in accordance with one or more embodiments of the present disclosure. In some embodiments, the lash cartridge 106 may have one or more features to selectively deploy lashes 107, such as, but not limited to, a slot 131 or hole on an outer casing (sometimes referred to as the "outer spool") of the lash cartridge 106.

As the tweezers 112 are extended, the restrictor 114 may force the tweezers 112 to close/clamp. For example, as the tweezers 112 move from the rest position to the extended position, an opening in the restrictor plate 114 that is smaller than the widest portion of the tweezers 112 will allow for only the distal portion of the tweezers 112 to pass through the opening while squeezing the tweezers 112 together. This action causes the tweezers 112 to grasp one or more lashes 107 that are deployed from the lash cartridge 106. After the lash 107 is grasped, the linear motion of the tweezers 112 may pluck/peel the lash 107 from the lash cartridge 106. It is to be understood that the recitations of a linear motor/actuator are not intended to be limiting. For example, suitable linear motion may be accomplished by a wide variety of linear motors and/or purely mechanical systems.

FIGS. 4A and 4B illustrate the handheld device 100 in a deployed state with the tweezers 112 extended to apply the one or more lashes 107 (e.g., to attach the one or more lashes 107 to a natural lash/eyelid of an individual receiving the eyelash extensions). For example, the tweezers 112 are configured to extend the one or more lashes 107 grasped by the tweezers 112 through the opening 104 at the distal end 101 of the device enclosure 102 when the tweezers 112 are in the extended position.

After the lash 107 is deployed by the tweezers 107 through the opening 104 as the distal end 101 of the device enclosure 102, the lash 107 may be attached to a natural lash and/or an eyelid by an adhesive, glue, magnetic paint, or any other suitable attachment means. For example, an adhesive may be applied to the lash 107 after the lash 107 is deployed through the opening 104. Alternatively, the lash 107 may come with adhesive pre-attached. In other embodiments, the lash 107 may have a magnetic base, where the lash 107 may magnetically couple to magnetic paint on the eyelid. The handheld device 100 may also employ any other suitable technique for attaching eyelash extensions.

FIGS. 5A through 5D illustrate a tweezer mount 113, in accordance with one or more embodiments of the present disclosure. The tweezer mount 113 may be configured to retain the tweezers 112. For example, the tweezers 112 may be retained by the tweezer mount 113 by any means, including, but not limited to, an interference fit, adhesives, or set screws. The tweezer mount 113 may be further configured to attach to one or more components of the handheld device 100, such as, but not limited to, the tweezer actuator 110. For example, the tweezer actuator 110 may be configured to selectively actuate the tweezers 112 by advancing the tweezer mount 113 (e.g., as illustrated in FIGS. 2A through 4B). In some embodiments, the tweezer mount 113 and/or tweezers 112 may be detachable from the tweezer actuator 110. This allows for the tweezers 112 to be sanitized and sterilized between uses. It is to be understood that the tweezer mount 113 is not necessarily limited by the depictions in the figures. For example, the tweezer mount 113 may be of any suitable shape, size, and/or dimension for securing tweezers 112 to a tweezer actuator 110.

FIGS. 6A through 6D illustrate tweezers 112, in accordance with one or more embodiments of the present disclosure. The tweezers 112 may include a piece of metal formed/bent into a shape configured to engage with and grasp one or more lashes 107. In embodiments, the tweezers 112 may include internal stresses for shape memory. For example, the tweezers 112 may be configured to return to an open state after releasing the one or more lashes 107 (i.e., when the tweezers 112 are no longer forced together/closed by the restrictor 114).

FIGS. 7A through 7D illustrate the restrictor 114 (e.g., a restrictor plate), in accordance with one or more embodiments of the present disclosure. In embodiments, the restrictor 114 may assist the tweezers 112 in returning to the rest position. The restrictor 112 may employ one or more springs to provide a spring force to assist in returning to the rest position. For example, FIGS. 3A and 3B illustrate a restrictor plate 114 with one or more springs 115 coupled to the restrictor plate 114 and configured to bias the restrictor plate 114 toward the tweezers 112. As shown in FIGS. 4A and 4B, when the one or more springs 115 are in an extended configuration, such that the spring force will pull the restrictor plate 114 towards the rest position. The use of springs 115 may allow the restrictor plate 114 to move forward with the tweezers 112, prevent slamming, reduce noise, improve durability, and increase the system lifetime. The configuration of the springs 115 depicted in the figures is not intended to be limiting. For example, there may be any number of springs 115, in any arrangement and attached in a number of ways to one or more of the system/device components (e.g., to the tweezer actuator 110, tweezers 112, restrictor plate 114, device enclosure 102, etc.).

FIGS. 8A through 8G illustrate the lash cartridge 106, in accordance with one or more embodiments of the present disclosure. In some embodiments, the lash cartridge 106 may include one or more structures configured to mate with complementary structures on the device enclosure 102 so that the lash cartridge 106 may be snapped into the device enclosure 102. This is one example of how the lash cartridge 106 may be removably coupled to the device enclosure 102. However, this is not intended to be limiting. For example, in other embodiments, the lash cartridge 106 may be reversibly or permanently attached within the handheld device 100 to a gear or a rotary actuator. Consequently, the handheld device 100 may require removal of a portion of the device enclosure 102 to refill and/or replace the lash cartridge 106.

The lash cartridge 106 may include a drive gear portion 127 configured with any geometry suitable for engaging with a drive gear of the cartridge actuator 122. For example, the drive gear portion 127 of the lash cartridge may include tooth-like structures or indentations configured to engage complementary structures on the drive gear. The drive gear portion 127 may enable the cartridge actuator 122 (e.g., a rotary stepper or the like) to selectively rotate the lash cartridge 106. The ability to selectively rotate the lash cartridge 106 may enable one or more lashes 107 stored within (or disposed upon) the lash cartridge 106 to be deployed to the tweezers 112.

The lash cartridge 106 may include an inner cylinder 126 (sometimes referred to as the "inner spool") and an outer cylinder 130 (sometimes referred to as the "outer spool"). The inner cylinder 126 may include the drive gear portion 127, and in some embodiments, the outer cylinder 130 may include the one or more structures configured to mate with complementary structures on the device enclosure 102 so that the lash cartridge 106 may be snapped into the device enclosure 102.

In embodiments, the outer cylinder 130 includes a slot 131 or opening for individual lashes 107 or clusters of lashes to be deployed through. The lash cartridge 106 may store a plurality of individual lashes (i.e., eyelash extension lashes) on the outer surface of the inner cylinder 126. When the lash cartridge 106 is turned, one or more lashes 107 may extend through the slot 131 so that the one or more lashes 107 can be grasped by the tweezers 112.

There may be a variety of configurations, directions, patterns, arrangements, and means of storing the lashes 107 in/on the lash cartridge 106, such as, but not limited to, disposing the lashes 107 in between the inner cylinder 126 and the outer cylinder 130 using a lash strip 128 or by disposing the lashes 107 directly on a component (e.g., the inner cylinder 126) of the lash cartridge 106. For example, a lash strip 128 may be adhered or otherwise disposed upon the outer surface of the inner cylinder 126. The base of each lash 107 may be adhered to the lash strip 128, such that the end of each lash 107 curves outward. Because of the curvature of the individual lashes 107, an individual or a group of lashes 107 may be deployed through the slot 131 of the outer cylinder 131 (e.g., as illustrated in FIGS. 2A through 3B) when the lash cartridge 106 is turned. The ability to stick a lash strip 128 onto the outer surface of the inner cylinder 126, may allow for the lash cartridge 106 to be used with commercially available off-the-shelf lash strips 128. In other embodiments, individual lashes 107 may be directly attached to the inner cylinder 126 or to another component of the lash cartridge 106. In embodiments where the lashes 107 are stored within or on the lash cartridge 106 without the use of conventional lash strips 128, the lash cartridge 106 or a portion thereof (e.g., the inner cylinder 126) may be disposable/replaceable. Attaching the lashes 107 directly to the lash cartridge 106 may allow for arrangements of lashes 107, such as, but not limited to, circular or helical. Furthermore, a disposable lash cartridge may be configured with lashes of different diameters, lengths, curls, colors, and shapes. In such embodiments, an esthetician may be able to select the disposable lash cartridge based on a user's preference.

The lash cartridge 106 may be selectively controllable to deploy one or more lashes 107. For example, the lash cartridge may include a drive gear portion 127 attached to a cartridge actuator 122 (e.g., an electrical motor, servo, stepper motor, or any other rotary actuator). The cartridge actuator 122 may be connected to the drive gear portion 127 by a drive gear. In embodiments, the drive gear may turn the inner cylinder 126 of the lash cartridge 106 to align one or more lashes 107 with the slot 131 of the outer cylinder 131 so that the one or more lashes 107 are deployed from the lash cartridge 106 through the slot 131. The use of drive gear and drive gear portion 127 is not intended to be limiting. For example, a drive gear may include any number of suitable gears of differing or similar diameter, number of teeth, helical direction, type (e.g., spur, helical, internal/external, bevel, straight, miter, screw, worm, crown, etc.), and/or other characteristic. The drive gear may further include reducer gears as needed to compensate for the rotary motion.

It is to be understood that there may be methods of selectively deploying lashes 107 from the lash cartridge 106, other than the use of a rotary cartridge actuator 122, such as, but not limited to, purely mechanical systems including gears, levers, pulleys, incline planes, spring, pick roller, and/or rack and pinions. For example, the lash cartridge 106 may be spring-loaded within the device enclosure 102 (e.g., by a pullback motor) so that the lash cartridge 106 may be allowed to turn when a load on the lash cartridge 106 is release (e.g., as the tweezers 112 return to a rest position). Turning the lash cartridge 106 may cause the one or more lashes 107 to be deployed through the slot 131.

The lash cartridge 106 may be reversibly attachable to the handheld device 100. For example, the lash cartridge 106 may be removably coupled to the device enclosure 102 and/or cartridge actuator 122. When the lash cartridge 106 is removably attached, the lash cartridge 106 can be held in place during use and then removed/replaced when the lash cartridge 106 runs out of lashes 107. However, this is not intended to be limiting. For example, in other embodiments, the lash cartridge 106 may be permanently coupled to the cartridge actuator 122 or another component within the device enclosure 102. In such embodiments, the device enclosure 102 may feature a removable cover to allow access to the lash cartridge 106 (e.g., for refilling and/or replacing a portion of (e.g., lash strip 128 or inner spool 126) of the lash cartridge 106).

In embodiments where a lash strip 128 is disposed upon the inner cylinder 126, the inner cylinder 126 may further comprise a lip, groove, or slot. A lip, groove, or slot may help the inner cylinder 126 retain the lash strip 128. For example, these features may prevent the lash strip 128 from being accidentally removed from the inner cylinder 126 as the inner cylinder 126 rotates or as lashes 107 are removed from the lash strip 128. Furthermore, a lip, groove, or slot may be beneficial if the lash strip 128 lacks an adhesive backing, or where the adhesive backing has insufficient adhesive strength to retain the lash strip 128 on the inner cylinder 126.

The handheld device 100 may be configured to deploy a single lash 107 or a plurality of lashes 107. For example, the handheld device 100 may deploy a single lash 107 or a plurality of lashes 107 per each rest and extend cycle. The ability to deploy a plurality of lashes 107 per cycle may be desirable in allowing an esthetician to attach multiple lashes 107 (e.g., a cluster of lashes 107) per natural lash. In some embodiments, the handheld device 100 may be configured to deploy multiple lashes 107 based on a particular user input (e.g., pressing a button multiple times to signal the deployment of multiple lashes 107 rather than an individual lash 107). In such embodiments, the user input may cause the motion controller 116 to signal the cartridge actuator 122 to rotate the lash cartridge 106 so that each input (e.g., each press of the button) selectively deploys a lash 107 from the lash cartridge 106 to be grasped by the tweezers 112. This may effectively queue multiple lashes 107 to be grasped by the tweezers 112 (e.g. as the lashes 107 are deployed through slot 131). It is to be understood that where a first user input controls the lash cartridge 106 to deploy one or more lashes 107, a second user input may be required to deploy the tweezer actuators 112. However, this is not intended to be limiting. For example, a single user input may cause a lash 107 and the tweezers 112 to be deployed, such that a second user input is not required.

In some embodiments, the handheld device 100 may further include a guide/status light 124 (e.g., an LED, LED bar, or LED ring). For example, in the embodiments illustrated by FIGS. 1A and 4B, the guide/status light 124 is an LED ring that may illuminate the eyelid being worked upon so that an esthetician can see more clearly when they are applying the eyelash extensions. The guide/status light 124 may be further configured to act as an indicator for a battery level or other status (e.g., direction indicator, on/off status, etc.) of the handheld device 100.

Figure 10:
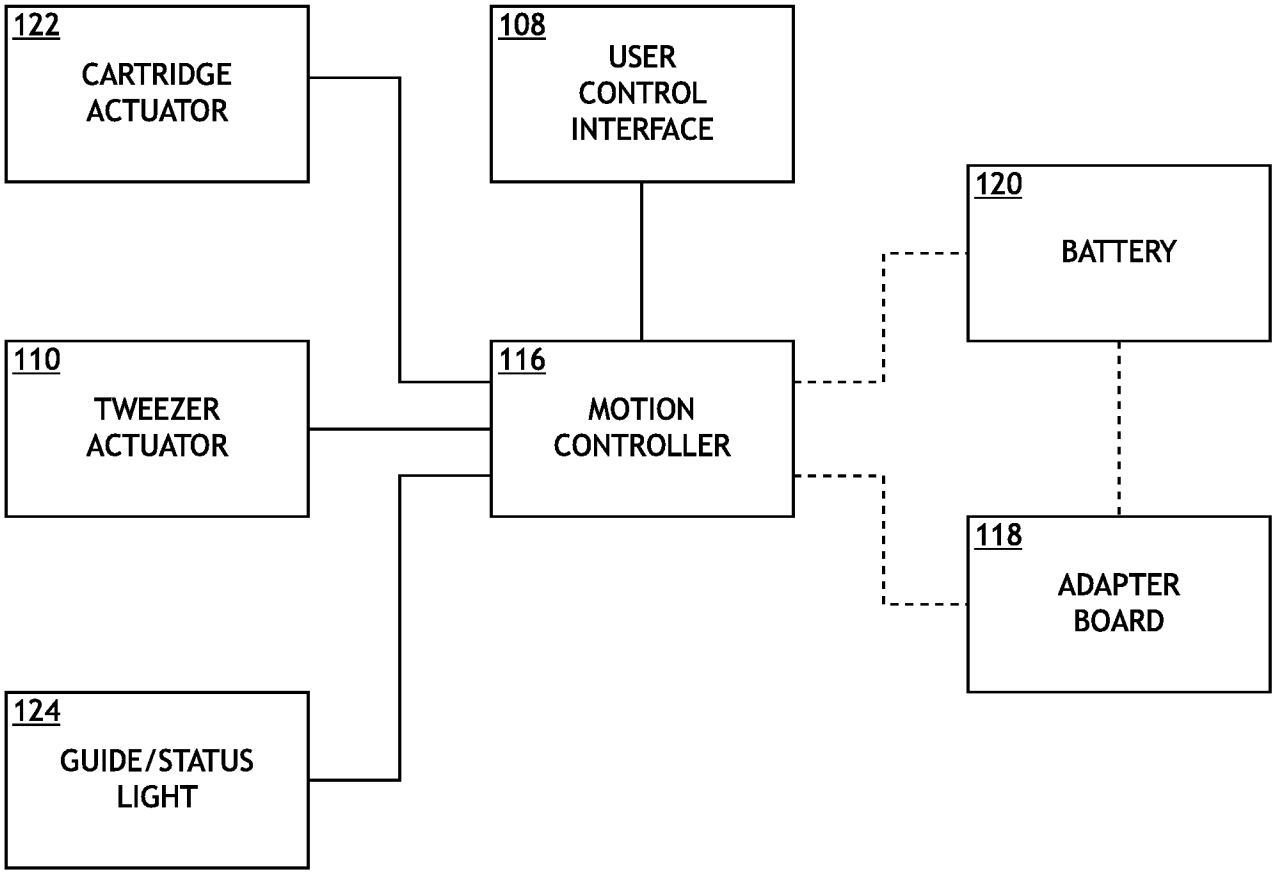
FIG. 10 is a block diagram illustrating connectivity between electronic components of the handheld device for applying eyelash extensions, in accordance with one or more embodiments of the present disclosure.

FIG. 10 is a block diagram illustrating connectivity between electronic components of the handheld device 100, in accordance with one or more embodiments of the present disclosure. In embodiments, one or more controllers (e.g., motion controller 116) may be configured to receive user inputs via the user control interface 108 (e.g., buttons, switches, toggles, touchpad, etc.) and configured to control various components (e.g., cartridge actuator 122, tweezer actuator 110, guide/status light 124, etc.) of the handheld device 100 based upon the user inputs. In some embodiments, the motion controller 116 may be configured to distribute power from the battery 120 to the various components. Alternatively, components may be independently powered by the battery 120. In other embodiments, the adapter board 118 may be configured to distribute power from the battery 120 to the motion controller 116 and/or any of the other components.

In some embodiments, the motion controller 116 (or any other controller of the handheld device 100) may include at least one processor, memory, and a communication interface.

A processor provides processing functionality for at least the controller and can include any number of processors, micro-controllers, circuitry, field programmable gate array (FPGA) or other processing systems, and resident or external memory for storing data, executable code, and other information accessed or generated by the controller. The processor can execute one or more software programs embodied in a non-transitory computer readable medium (e.g., memory) that implement techniques/operations described herein. The processor is not limited by the materials from which it is formed or the processing mechanisms employed therein and, as such, can be implemented via semiconductor(s) and/or transistors (e.g., using electronic integrated circuit (IC) components), and so forth.

Memory can be an example of tangible, computer-readable storage medium that provides storage functionality to store various data and/or program code associated with operation of the controller/processor, such as software programs and/or code segments, or other data to instruct the processor, and possibly other components of the controller, to perform the functionality described herein. Thus, the memory can store data, such as a program of instructions for operating the controller, including its components (e.g., processor, communication interface, etc.), and so forth. It should be noted that while a single memory is described, a wide variety of types and combinations of memory (e.g., tangible, non-transitory memory) can be employed. The memory can be integral with the processor, can comprise stand-alone memory, or can be a combination of both. Some examples of the memory can include removable and non-removable memory components, such as random-access memory (RAM), read-only memory (ROM), flash memory (e.g., a secure digital (SD) memory card, a mini-SD memory card, and/or a micro-SD memory card), solid-state drive (SSD) memory, magnetic memory, optical memory, universal serial bus (USB) memory devices, hard disk memory, external memory, and so forth.

A communication interface can be operatively configured to communicate with components of the controller. For example, the communication interface can be configured to retrieve data from the processor or other devices, transmit data for storage in the memory, retrieve data from storage in the memory, and so forth. The communication interface can also be communicatively coupled with the processor to facilitate data transfer between components of the controller and the processor. It should be noted that while the communication interface is described as a component of the controller, one or more components of the communication interface can be implemented as external components communicatively coupled to the controller.

It shall be understood that the operations are not necessarily all performed by one controller. In some embodiments, the operations may be performed by one or controllers. For example, one or more operations and/or sub-operations may be performed by a first controller, additional operations and/or sub-operations may be performed by a second controller, and so forth. Furthermore, some of the operations and/or sub-operations may be performed in parallel and not necessarily in the order that they are disclosed herein.

Much of the present disclosure is described in the context of a handheld device 100 for applying eyelash extensions. However, it is further contemplated that embodiments of the present disclosure may also be applied to other devices and systems, for example, any devices or systems that include lash cartridges 106, tweezer actuators 110, etc., as those components/sub-systems are described herein. Furthermore, it is contemplated that there may be other uses for components/sub-systems of the present disclosure (e.g., the tweezer actuator 110, restrictor 114, etc.) including, but not limited to, robotic applications.

Although the technology has been described with reference to the embodiments illustrated in the attached drawing figures, equivalents may be employed and substitutions may be made herein without departing from the scope of the technology as recited in the claims. Components illustrated and described herein are examples of devices and components that may be used to implement the embodiments of the present invention and may be replaced with other functionally equivalent devices and components without departing from the scope of the invention. Furthermore, any dimensions, degrees, and/or numerical ranges provided herein are to be understood as non-limiting examples unless otherwise specified in the claims.

What is claimed is:

1. A handheld device for applying eyelash extensions, comprising:

a device enclosure with an opening at a distal end of the device enclosure;

tweezers at least partially disposed within the device enclosure, the tweezers configured to grasp one or more lashes from a lash cartridge at least partially disposed within or coupled to the device enclosure; and a tweezer actuator coupled to the tweezers and at least partially disposed within the device enclosure, the tweezer actuator configured to selectively position the tweezers between a rest position and an extended position, wherein the tweezers and the one or more lashes grasped by the tweezers are configured to extend through the opening and past the distal end of the device enclosure when the tweezers are in the extended position.

2. The handheld device of claim 1, further comprising:

a cartridge actuator configured to selectively rotate the lash cartridge to position the one or more lashes relative to the tweezers.

3. The handheld device of claim 1, wherein the lash cartridge is removably coupled to the device enclosure.

4. The handheld device of claim 1, wherein the lash cartridge comprises:

an inner spool configured to hold the one or more lashes; and an outer spool configured to surround at least a portion of the inner spool so that the one or more lashes are stored between the inner spool and the outer spool.

5. The handheld device of claim 4, wherein the one or more lashes are adhered to a lash strip attached to an outer surface of the inner spool.

6. The handheld device of claim 4, wherein the one or more lashes are adhered directly to an outer surface of the inner spool.

7. The handheld device of claim 1, further comprising:

a restrictor configured to surround at least a portion of the tweezers and force the tweezers together when the tweezers are extended to grasp the one or more lashes from the lash cartridge.

8. The handheld device of claim 7, wherein the restrictor comprises:

a restrictor plate with an opening configured to surround at least a portion of the tweezers; and a spring coupled to the restrictor plate and configured to bias the restrictor plate toward the tweezers.

9. The system handheld device of claim 1, further comprising:

a battery configured to power the tweezer actuator; and an adapter board configured to charge the battery from an external power source.

10. The handheld device of claim 1, wherein the tweezer actuator comprises a linear actuator.

11. A system for applying eyelash extensions, comprising:

a lash cartridge;

a device enclosure with an opening at a distal end of the device enclosure;

tweezers at least partially disposed within the device enclosure, the tweezers configured to grasp one or more lashes from the lash cartridge; and a tweezer actuator coupled to the tweezers and at least partially disposed within the device enclosure, the tweezer actuator configured to selectively position the tweezers between a rest position and an extended position, wherein the tweezers and the one or more lashes grasped by the tweezers are configured to extend through the opening and past the distal end of the device enclosure when the tweezers are in the extended position.

12. The system of claim 11, further comprising:

a cartridge actuator configured to selectively rotate the lash cartridge to position the one or more lashes relative to the tweezers.

13. The system of claim 11, wherein the lash cartridge is removably coupled to the device enclosure.

14. The system of claim 11, wherein the lash cartridge comprises:

an inner spool configured to hold the one or more lashes; and an outer spool configured to surround at least a portion of the inner spool so that the one or more lashes are stored between the inner spool and the outer spool.

15. The system of claim 14, wherein the one or more lashes are adhered to a lash strip attached to an outer surface of the inner spool.

16. The system of claim 14, wherein the one or more lashes are adhered directly to an outer surface of the inner spool.

17. The system of claim 11, further comprising:

a restrictor configured to surround at least a portion of the tweezers and force the tweezers together when the tweezers are extended to grasp the one or more lashes from the lash cartridge.

18. The system of claim 17, wherein the restrictor comprises:

a restrictor plate with an opening configured to surround at least a portion of the tweezers; and a spring coupled to the restrictor plate and configured to bias the restrictor plate toward the tweezers.

19. The system of claim 11, further comprising:

a battery configured to power the tweezer actuator;

an adapter board configured to charge the battery from an external power source; and a charging base configured to furnish power from the external power source to the adapter board.

20. The system of claim 11, wherein the tweezer actuator comprises a linear actuator.

* * * * *